US011250796B2

(12) United States Patent
Liu

(10) Patent No.: US 11,250,796 B2
(45) Date of Patent: Feb. 15, 2022

(54) DISPLAY DRIVING CIRCUIT AND LIQUID CRYSTAL DISPLAY PANEL

(71) Applicant: Shenzhen China Star Optoelectronics Semiconductor Display Technology Co., Ltd., Guangdong (CN)

(72) Inventor: Daijin Liu, Shenzhen (CN)

(73) Assignee: SHENZEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 196 days.

(21) Appl. No.: 16/626,722

(22) PCT Filed: Dec. 12, 2019

(86) PCT No.: PCT/CN2019/124824
§ 371 (c)(1),
(2) Date: Dec. 26, 2019

(87) PCT Pub. No.: WO2021/109194
PCT Pub. Date: Jun. 10, 2021

(65) Prior Publication Data

US 2021/0358428 A1 Nov. 18, 2021

(30) Foreign Application Priority Data

Dec. 4, 2019 (CN) ..... 201911226872.9

(51) Int. Cl.
*G09G 3/36* (2006.01)

(52) U.S. Cl.
CPC ..... *G09G 3/36* (2013.01); *G09G 2300/0809* (2013.01); *G09G 2320/0233* (2013.01); *G09G 2320/0242* (2013.01)

(58) Field of Classification Search
CPC ..... G09G 3/36; G09G 2320/0242; G09G 2300/0809; G09G 2320/0233
See application file for complete search history.

(56) References Cited

U.S. PATENT DOCUMENTS 8,860,697 B2 * 10/2014 Lee ..... G09G 3/3611 345/204
9,691,791 B2 6/2017 Jeon et al.
(Continued)

FOREIGN PATENT DOCUMENTS

CN 103762204 A 4/2014
CN 103886844 A 6/2014
(Continued)

*Primary Examiner* — Benyam Ketema
(74) *Attorney, Agent, or Firm* — Benesch, Friedlander, Coplan & Aronoff LLP

(57) ABSTRACT

A display driving circuit and a liquid crystal display panel are provided. The display driving circuit includes: a control board used to provide a control signal; a plurality of display chips electrically connected to the control board and providing a driving signal according to the control signal; a plurality of equalizing resistors corresponding to the display chips, wherein an end of the equalizing resistors is connected to the control board, and other end of the equalizing resistors is connected to the display chips, and they are used to equalize an impedance the display driving circuit; a plurality of fan-out routes, wherein each of the fan-out routes is connected to the two adjacent display chips; and a pixel bus connected to the plurality of fan-out routes and used to transmit the driving signal to each of pixel units. The present disclosure effectively improves display effect by that mentioned above.

15 Claims, 1 Drawing Sheet

(56) References Cited

U.S. PATENT DOCUMENTS

| | | | | |
|---|---|---|---|---|
| 2008/0246752 | A1* | 10/2008 | Lee | G09G 3/20 345/213 |
| 2010/0283955 | A1* | 11/2010 | Kim | G02F 1/1345 349/149 |
| 2015/0181701 | A1* | 6/2015 | Li | H05K 1/0296 361/749 |
| 2015/0187294 | A1* | 7/2015 | Chen | G09G 3/3685 345/205 |
| 2017/0098423 | A1* | 4/2017 | Tang | G09G 3/3688 |
| 2017/0154599 | A1* | 6/2017 | Huang | G09G 3/20 |
| 2018/0130929 | A1 | 5/2018 | Kim et al. | |
| 2021/0035521 | A1* | 2/2021 | Qiu | G09G 3/2003 |

FOREIGN PATENT DOCUMENTS

| | | | | |
|---|---|---|---|---|
| CN | 106816142 | A | 6/2017 | |
| CN | 107248388 | A | 10/2017 | |
| CN | 109166515 | * | 10/2018 | G09G 3/20 |
| CN | 109166515 | A | 1/2019 | |
| KR | 20180052161 | A | 5/2018 | |

* cited by examiner

DISPLAY DRIVING CIRCUIT AND LIQUID CRYSTAL DISPLAY PANEL

FIELD OF INVENTION

The present disclosure relates to the field of liquid crystal display, and particularly relates to a display driving circuit and a liquid crystal display panel.

BACKGROUND OF INVENTION

With development of science and technology, applications of liquid crystal display panels are increasingly wider in people's daily life, and dimensions of liquid crystal display panels are increasingly larger.

However, reasons such as route lengths, route lengths, route processes, etc. of a fan-out region of liquid crystal display panels cause in-plane impedance of the liquid crystal display panels is not matched, so that difference of darkness and brightness of the liquid crystal display panels may occur, this affects display quality and lowers user visual experience.

SUMMARY OF INVENTION

The present disclosure mainly solves the technical problem by providing a display driving circuit and a liquid crystal display panel, that can effectively improve display effect.

In order to solve the technical problem mentioned above, one of the technical solutions used by the present disclosure is to provide a display driving circuit, which includes: a control board used to provide a control signal; a plurality of display chips electrically connected to the control board and providing a driving signal according to the control signal; a plurality of equalizing resistors corresponding to the plurality of display chips, wherein an end of the plurality of equalizing resistors is connected to the control board, and other end of the plurality of equalizing resistors is connected to the plurality of display chips, and the plurality of equalizing resistors are used to equalize an impedance the display driving circuit; a plurality of fan-out routes, wherein each of the fan-out routes is connected to the two adjacent display chips; and a pixel bus connected to the plurality of fan-out routes and used to transmit the driving signal to each of pixel units.

Furthermore, a plurality of resistance values of the plurality of equalizing resistors are adjustable.

Furthermore, the plurality of resistance values of the plurality of equalizing resistors are determined according to an actual display effect.

Furthermore, the plurality of resistance values of the plurality of equalizing resistors are equal.

Furthermore, a plurality of capacitors corresponds to the display chips, and an end of the plurality of capacitors is connected to the other end of the plurality of equalizing resistors, and other end of the plurality of capacitors is grounded.

Furthermore, the display driving circuit is used to drive a liquid crystal display panel.

Furthermore, the present disclosure further includes that the other end of the plurality of equalizing resistors is connected to the control board by connecting a plurality of control buses.

In order to solve the technical problem mentioned above, another technical solution used by the present disclosure is to provide a liquid crystal display panel, which includes a display component and a display driving circuit, and the display driving circuit is the display driving circuit mentioned above.

Furthermore, the display component includes a plurality of main pixel units and a plurality of assistant pixel units which are spaced apart.

Furthermore, the main pixel units and the assistant pixel units are driven by at least three thin film field effect transistors.

The present disclosure has beneficial effect as the following:

by adding equalizing resistors between the display chips and the control board to match the impedance of the plurality of fan-out routes, thereby the display driving circuit provided by the present disclosure enabling to prevent from situation of color unevenness or brightness unevenness occurring during displaying, and effectively improving display effect.

DESCRIPTION OF DRAWINGS

To more clearly illustrate the technical solutions of the embodiments of the present disclosure, the accompanying figures of the present disclosure will be described in brief. Obviously, the accompanying figures described below are only part of the embodiments of the present disclosure, from which those skilled in the art can derive further figures without making any inventive efforts.

DETAILED DESCRIPTION OF PREFERRED EMBODIMENTS

The technical solutions in the embodiments of the present disclosure are clearly and completely described in the following with reference to the accompanying drawings in the embodiments of the present disclosure. Obviously, the described embodiments are only part of the embodiments of the present disclosure, but are not all embodiments of the present disclosure. All other embodiments obtained by those skilled in the art based on the embodiments of the present disclosure without creative efforts are within the scope of the present disclosure.

Figure 1:
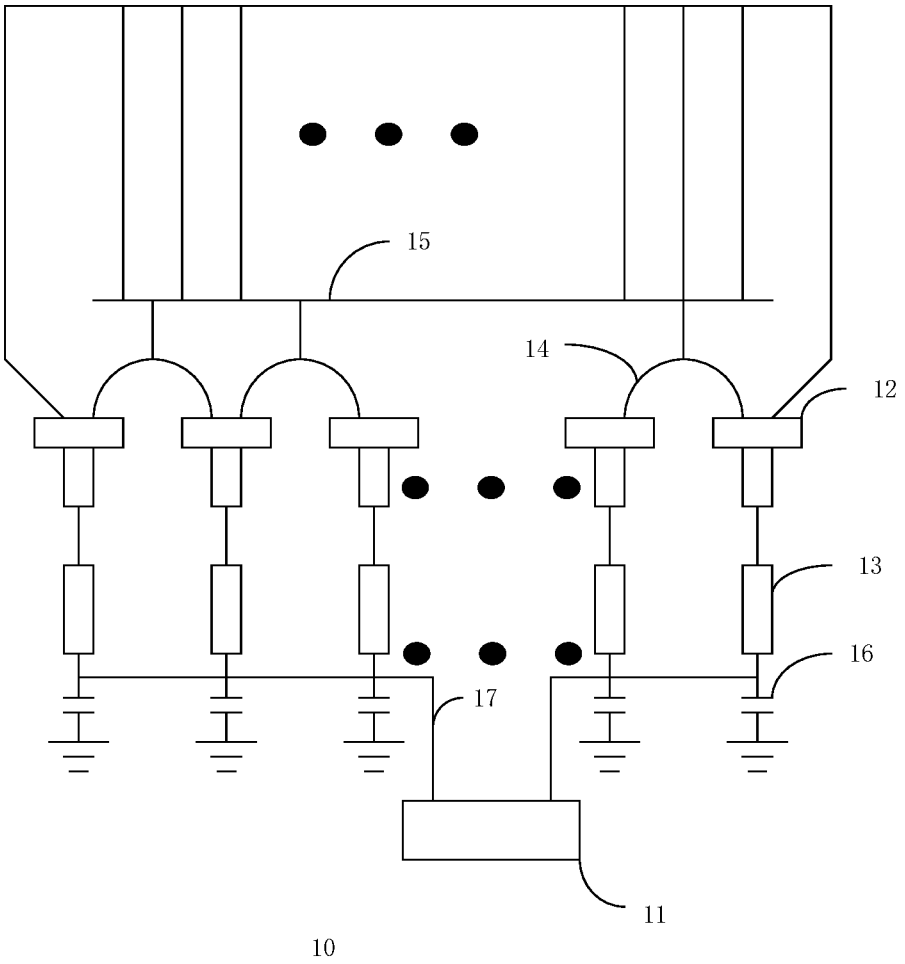
FIG. 1 is a structural schematic diagram of an embodiment of a display driving circuit provided by the present disclosure.

Please refer to FIG. 1, FIG. 1 is a structural schematic diagram of an embodiment of a display driving circuit provided by the present disclosure. A display driving circuit 10 includes a control board 11, a plurality of display chips 12, a plurality of equalizing resistors 13, a plurality of fan-out routes 14, and a pixel bus 15.

The control board 11 is used to provide a control signal and is used to provide working electric sources of each components of the display driving circuit 10. The plurality of display chips 12 are respectively connected to the control board 11 and to generate a driving signal according to the control signal provided by the control board 11. The driving signal is used to transmit to each pixel unit to drive each pixel unit to display. In this implementation scenario, the display chips 12 are chip-on-film (COF) chips, and in other implementation scenarios, the display chips 12 may be chip-on-glass (COG) chips or other chips. Each of the fan-out routes 14 is connected to the two adjacent display chips 12. The pixel bus 15 is connected to the plurality of fan-out routes 14 and is connected to each of the pixel units. The driving signal is transmitted to the pixel bus 15 through the fan-out routes 14, and the pixel bus 15 transmits the driving signal to each of the pixel units. In this implementation scenario, each of the fan-out routes 14 has three ends which are interconnected. Two of the ends are used to respectively connect to the two adjacent display chips 12, and other end is used to connect to the pixel bus 15. The plurality of equalizing resistors 13 corresponds to the plurality of display chips 12 one by one. An end of each of the equalizing resistors 13 is correspondingly connected to the display chips 12, and other end of each of the equalizing resistors 13 is connected to the control board 11. The plurality of equalizing resistors are used to equalize an impedance of the plurality of fan-out routes 14.

When the control board 11 provides the control signal and the electric sources, the plurality of equalizing resistors 13 can be matched to the impedance of the plurality of fan-out routes 14, this makes in-plane impedance of the liquid crystal display panel be matched, so that during displaying, situation of color unevenness or brightness unevenness due to mismatching of impedance does not occur.

It can be understood by the description mentioned above, that in this embodiment, by adding equalizing resistors between the display chips and the control board to match the impedance of the plurality of fan-out routes, thereby enabling to prevent from situation of color unevenness or brightness unevenness occurring during displaying, and effectively improving display effect.

Furthermore, please continue referring to FIG. 1. In this embodiment, a plurality of resistance values of the plurality of equalizing resistors 13 can be adjusted according to actual requirements. Route widths, route lengths, and route processes of the plurality of fan-out routes 14 of the display driving circuit 10 manufacturing for different liquid crystal display panels are not consistent, so resistance values of the equalizing resistors 13 required for the display driving circuit 10 manufacturing for different liquid crystal display panels are also changing. Therefore, the resistance values of the equalizing resistors 13 are adjustable to satisfy different requirements of different liquid crystal display panels.

In this implementation scenario, it is enable to adjust the resistance values of the plurality of equalizing resistors 13 according to actual display effect of the liquid crystal display panel driven by the display driving circuit 10. Specifically, lighting up the liquid crystal display panel driven by the display driving circuit 10 to observe with naked eyes or to use an instrument to measure whether the liquid crystal display panel has the problem of color unevenness or brightness unevenness, if the problem exists, correspondingly adjusting the resistance values of the equalizing resistor 13 according to severity of the problem until user observes with naked eyes or uses the instrument to measure the display of the liquid crystal display panel to meet the requirement.

Because in-plane impedance of liquid crystal display panels in the same lot and the same model are substantially consistent, when the resistance values of the plurality of equalizing resistors 13 are determined, they can be used in the display driving circuits 10 of liquid crystal display panels in the same lot and the same model are substantially consistent, and which operability is high.

In this implementation scenario, the resistance values of the plurality of equalizing resistors 13 of the display driving circuit 13 are equal, therefore, when adjusting the plurality of equalizing resistors 13, all the equalizing resistors 13 can be simultaneously adjusted. Moreover, the resistance values of the plurality of equalizing resistors 13 are equal, so processes of subsequent manufacturing are relatively simple, and operability is high.

It can be understood by the description mentioned above, that in this embodiment, the resistance values of the plurality of equalizing resistors can be adjusted according to actual display effect, this can effectively ensure the impedance of the equalizing resistors to match the impedance of the fan-out routes and can ensure display quality, and the resistance values of the equalizing resistors are equal, which can effectively improve efficiency of production.

Furthermore, please continue referring to FIG. 1. The display driving circuit 10 further includes a plurality of capacitors 16. The capacitors 16 correspond to the display chips 12 one by one. An end of the plurality of capacitors 16 is connected to the end of the equalizing resistors 13 connected to the control board 11, and other end of the capacitors 16 is grounded. The capacitors 16 are used to maintain stability of the driving circuit 10.

Control buses 17 are further disposed in the display driving circuit 10, and an end of the control buses 17 is connected to the control board 11. The other end of the plurality of equalizing resistors 13 is connected to the control board 11 by connecting to the control buses 17. In this implementation scenario, two control buses 17 are disposed.

In this implementation scenario, the display driving circuit 10 is used to drive the liquid crystal display panel, and in other implementation scenario, the display driving circuit 10 may also be used to drive an organic light emitting diode (OLED) display panel or other type display panel.

Figure 2:
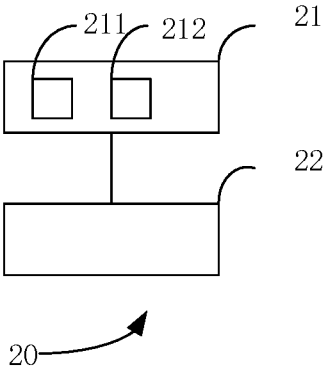
FIG. 2 is a structural schematic diagram of an embodiment of a liquid crystal display panel provided by the present disclosure.

Please refer to FIG. 2, FIG. 2 is a structural schematic diagram of an embodiment of a liquid crystal display panel provided by the present disclosure. The liquid crystal display panel 20 includes a display component 21 and a display driving circuit 22, and the display driving circuit is used to drive the display component 21 to display images. In this embodiment, the display driving circuit 22 is the display driving circuit illustrated in FIG. 1. When the control board provides the control signal and the electric sources, the plurality of equalizing resistors can be matched to the impedance of the plurality of fan-out routes, this makes in-plane impedance of the liquid crystal display panel be matched, so that during displaying, situation of color unevenness or brightness unevenness due to mismatching of impedance does not occur.

It can be understood by the description mentioned above, that in this embodiment, by adding equalizing resistors between the display chips and the control board to match the impedance of the plurality of fan-out routes, thereby preventing from situation of color unevenness or brightness unevenness occurring during displaying being enabled, and effectively display effect being improved.

Please continue referring to FIG. 2. The display component 21 includes a plurality of main pixel units 211 and a plurality of assistant pixel units 212 which are spaced apart. Furthermore, the main pixel units 211 and the assistant pixel units 212 are three thin film field effect transistor-plus (3T-plus) structures, which are driven by at least three thin film field effect transistors (TFTs).

It can be understood by the description mentioned above, that in this embodiment, by using the main pixel units and the assistant pixel units, this embodiment can effectively improve display effect, and the use of at least three TFTs can further improve the display effect.

Comparing this to the prior art, by adding equalizing resistors between the display chips and the control board to match the impedance of the plurality of fan-out routes, so the present disclosure enables to prevent from situation of color unevenness or brightness unevenness occurring during displaying, and effectively improving display effect.

The above descriptions only disclose the embodiments of the present disclosure, but do not limit the scope of the present disclosure. Thus, it is intended that the present disclosure cover modifications and variations that come within the scope of the appended claims and their equivalents, as well as direct or indirect applications of the embodiments in other related technical fields.

What is claimed is:

1. A display driving circuit, comprising:

a control board used to provide a control signal;

a plurality of display chips electrically connected to the control board and providing a driving signal according to the control signal;

a plurality of equalizing resistors corresponding to the plurality of display chips, wherein an end of the plurality of equalizing resistors is connected to the control board, and other end of the plurality of equalizing resistors is connected to the plurality of display chips, and the plurality of equalizing resistors are used to equalize an impedance of the display driving circuit;

a plurality of fan-out routes, wherein each of the fan-out routes is connected to two adjacent display chips;

a pixel bus connected to the plurality of fan-out routes and used to transmit the driving signal to each pixel units; and a plurality of capacitors corresponding to the display chips, wherein an end of the plurality of capacitors is connected to the other end of the plurality of equalizing resistors, and other end of the plurality of capacitors is grounded;

wherein a plurality of resistance values of the plurality of equalizing resistors are adjustable.

2. A display driving circuit, comprising:

a control board used to provide a control signal;

a plurality of display chips electrically connected to the control board and providing a driving signal according to the control signal;

a plurality of equalizing resistors corresponding to the plurality of display chips, wherein an end of the plurality of equalizing resistors is connected to the control board, and other end of the plurality of equalizing resistors is connected to the plurality of display chips, and the plurality of equalizing resistors are used to equalize an impedance of the display driving circuit;

a plurality of fan-out routes, wherein each of the fan-out routes is connected to two adjacent display chips;

a pixel bus connected to the plurality of fan-out routes and used to transmit the driving signal to each pixel units; and a plurality of capacitors corresponding to the display chips, wherein an end of the plurality of capacitors is connected to the other end of the plurality of equalizing resistors, and other end of the plurality of capacitors is grounded.

3. The display driving circuit as claimed in claim 2, wherein a plurality of resistance values of the plurality of equalizing resistors are adjustable.

4. The display driving circuit as claimed in claim 3, wherein the plurality of resistance values of the plurality of equalizing resistors are determined according to an actual display effect.

5. The display driving circuit as claimed in claim 4, wherein the plurality of resistance values of the plurality of equalizing resistors are equal.

6. The display driving circuit as claimed in claim 2, wherein the display driving circuit is used to drive a liquid crystal display panel.

7. The display driving circuit as claimed in claim 2, wherein the display driving circuit comprises:

the other end of the plurality of equalizing resistors is connected to the control board by connecting to a plurality of control buses.

8. A liquid crystal display panel, comprising a display component and a display driving circuit, wherein the display driving circuit comprises:

a control board used to provide a control signal;

a plurality of display chips electrically connected to the control board and providing a driving signal according to the control signal;

a plurality of equalizing resistors corresponding to the plurality of display chips, wherein an end of the plurality of equalizing resistors is connected to the control board, and other end of the plurality of equalizing resistors is connected to the plurality of display chips, and the plurality of equalizing resistors are used to equalize an impedance of the display driving circuit;

a plurality of fan-out routes, wherein each of the fan-out routes is connected to two adjacent display chips; and a pixel bus connected to the plurality of fan-out routes and used to transmit the driving signal to each of pixel units; and a plurality of capacitors corresponding to the display chips, wherein an end of the plurality of capacitors is connected to the other end of the plurality of equalizing resistors, and other end of the plurality of capacitors is grounded.

9. The liquid crystal display as claimed in claim 8, wherein a plurality of resistance values of the plurality of equalizing resistors are adjustable.

10. The liquid crystal display panel as claimed in claim 9, wherein the plurality of resistance values of the plurality of equalizing resistors are determined according to an actual display effect.

11. The liquid crystal display panel as claimed in claim 10, wherein the plurality of resistance values of the plurality of equalizing resistors are equal.

12. The liquid crystal display panel as claimed in claim 8, wherein the display driving circuit is used to drive a liquid crystal display panel.

13. The liquid crystal display panel as claimed in claim 8, wherein the liquid crystal display panel comprises:

the other end of the plurality of equalizing resistors is connected to the control board by connecting to a plurality of control buses.

14. The liquid crystal display panel as claimed in claim 8, wherein the display component comprises a plurality of main pixel units and a plurality of assistant pixel units which are spaced apart.

15. The liquid crystal display panel as claimed in claim 8, wherein a plurality of pixel units of the display component are driven by at least three thin film field effect transistors.

* * * * *